US006885837B2

(12) United States Patent
Matsubara

(10) Patent No.: US 6,885,837 B2
(45) Date of Patent: Apr. 26, 2005

(54) DRIVING FORCE TRANSMITTING APPARATUS AND IMAGE FORMING APPARATUS HAVING DRIVING FORCE TRANSMITTING APPARATUS

(75) Inventor: Hideyuki Matsubara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/374,989

(22) Filed: Feb. 28, 2003

(65) Prior Publication Data

US 2003/0223779 A1 Dec. 4, 2003

(30) Foreign Application Priority Data

Feb. 28, 2002 (JP) ..... 2002-052734

(51) Int. Cl.[7] ..... G03G 15/00
(52) U.S. Cl. ..... 399/167
(58) Field of Search ..... 399/107, 110, 399/167, 320, 381; 310/75 R; 74/640, 421 A

(56) References Cited

U.S. PATENT DOCUMENTS 5,634,178 A 5/1997 Sugiura et al. ..... 399/110
5,701,549 A * 12/1997 Portig et al. ..... 399/167 X
5,737,968 A * 4/1998 Hardey et al. ..... 74/421 A
5,740,503 A * 4/1998 Nakamura ..... 399/167
5,970,286 A * 10/1999 Numazu et al. ..... 399/167
6,125,253 A * 9/2000 Tashima et al. ..... 399/167
6,188,858 B1 * 2/2001 Swapceinski et al. ..... 399/167
6,198,890 B1 * 3/2001 Liu et al. ..... 399/107
6,234,037 B1 * 5/2001 Zimmer ..... 74/421 A
6,301,458 B1 * 10/2001 Mori et al. ..... 399/167

FOREIGN PATENT DOCUMENTS

JP 6-314001 11/1994

* cited by examiner

*Primary Examiner*—Sandra Brase
(74) *Attorney, Agent, or Firm*—Fitzpatrick, Cella, Harper & Scinto

(57) ABSTRACT

A driving force transmitting apparatus includes first and second transmitters for transmitting a driving force, a first mounting portion for mounting a driver for driving both of the first and second transmitters, and a second mounting portion for mounting a driver driving the first transmitter and not driving the second transmitter. A third mounting portion mounts a driver for driving the second transmitter and not driving the first transmitter.

15 Claims, 12 Drawing Sheets

DRIVING FORCE TRANSMITTING APPARATUS AND IMAGE FORMING APPARATUS HAVING DRIVING FORCE TRANSMITTING APPARATUS

FIELD OF THE INVENTION AND RELATED ART

The present invention relates to an image forming apparatus, for example, a copying machine, a laser beam printer, a facsimile machine, etc., employing an electrophotographic or electrostatic recording method. In particular, it relates to a driving force transmitting apparatus employed by such an image forming apparatus.

In recent years, progress has been rapidly made in the field of an image forming apparatus, for example, a copying machine, a printer, etc., in terms of speed, colorization, and image quality. Further, the cost of an image forming apparatus has also been rapidly declining. Presently, the mainstream laser beam printers are those having: a sheet feeding portion for feeding a single or plurality of sheets of recording medium into the main assembly of a printer; an image forming portion for forming an image on the sheet of recording medium, and a fixing portion for fixing the toner image on the sheet of recording medium.

Referring to FIGS. 11 and 12, the background arts of the present invention will be described. FIG. 11 is a schematic sectional view of a typical laser beam printer, for describing the structure thereof. FIG. 12 is a schematic drawing of the driving force transmitting portion of the laser beam printer.

First, the general structure of the laser beam printer will be described following the flow of a recording medium sheet. A plurality of sheets S of recording medium are stored in layers in a cassette 11 in the sheet feeding portion. They are sequentially dispensed from the cassette 11, one by one, starting from the topmost sheet, by a feeding roller 12, which rotates in the counterclockwise direction. Then, the sheets S are conveyed to the image forming portion 2 by a pair of conveying rollers 13 and 14. In the image forming portion 2, a beam of laser light is projected from a laser scanner 21, while being modulated with image formation information, onto a photoconductive member 22 which is rotating in the clockwise direction. As a result, an electrostatic latent image is formed on the photoconductive member 22. This electrostatic latent image is developed with toner, in the developing portion (unshown) in a process cartridge 23. The toner image is transferred onto the sheet of recording medium. Then, the sheet of recording medium bearing an unfixed toner image is sent to a fixing portion 3, in which the unfixed toner image is fixed to the sheet of recording medium. After the passage through the fixing portion 3, that is, after the completion of the fixing process, the sheet of recording medium is discharged from the main assembly of the image forming apparatus by a pair of conveying rollers 31. Next, a driving force transmitting portion 4 which drives the image forming means (sheet feeding portion 1, image forming portion 2, fixing portion 3) during the above described image forming process will be described in detail.

Referring to FIG. 12, the driving force transmitting portion 4 has a side plate 401, which has a hole 402, through which the shaft of the main motor is put. The pinion gear 424 of the main motor 403 is in mesh with a gear 404, which is connected to the photoconductive member 22, with the interposition of a coupling, transmitting the driving force frog the main motor, to the photoconductive member 22. The driving force is further transmitted from the photoconductive member 22 through an idler gear (unshown) in order to stir the toner within the process cartridge 23.

The pinion gear 424 is also in mesh with a gear 405, transmitting the driving force to the sheet feeding roller 12 through gears 406, 407, and 408, to the pair of conveying rollers 13 through gears 406, 407, and 409, and also to the pair of conveying rollers 14 through gears 406, 407, and 410.

Further, the driving force is transmitted from the pinion gear 424 to the fixing portion 3, and pair of discharge rollers 31, through gears 411–423. In other words, in this structural arrangement, the sheet feeding portion 1, image forming portion 2, and fixing portion 3, are all driven by a single driving force source, that is, the main motor 403.

In order to improve the image forming apparatus in terms of speed (faster) as well as image quality while retaining the above described structural arrangement, the fixing apparatus must be improved in performance. In order to improve the performance of the fixing apparatus, the fixing apparatus must be increased in pressure. Further, in order to form an image of higher quality, it is necessary to improve the pinion gear 424 of the main motor 403 in terms of precision. Further, in order to deal with the increased process cartridge capacity (larger), the torque required for stirring the toner in the process cartridge must be increased. In addition, it is necessary to extend the service life of the photoconductive member 22.

Therefore, the main motor 403 is required to output a greater amount of driving force, which results in increase in the external diameter of the main motor 403, making the external diameter of the main motor 403 too large for the main motor 403 to be placed in an image forming apparatus of a reduced size. Further, in order to extend the service life of a photoconductive member, it is necessary to keep the photoconductive member 22 stationary except while an image is transferred onto a sheet of recording medium. This requires a separation of control. Therefore, two or more motors are required to provide the apparatus with driving force. However, the driving force transmitting portion 4 of the image forming apparatus described above is capable of accommodating two or more motors. Thus, in order to improve the above described image forming apparatus in terms of speed (faster), image quality, and process cartridge capacity (larger), the apparatus must be provided with another driving force transmitting portion.

Thus, in order to improve an image forming apparatus in terms of operational speed, image quality, process cartridge capacity, and the service life of the photoconductive member, it is necessary to employ two or more motors to increase the torque and revolution of the driving force transmitting portion. In order to employ two or more motors, the driving force transmitting portion of the image forming apparatus must be capable of accommodating two or more motors; a driving force transmitting apparatus different from a driving force transmitting apparatus capable of accommodating only a single motor. In other words, according to the prior art, two or more types of driving force transmitting apparatuses are necessary in order to improve an image forming apparatus in terms of the above described aspects, increasing the manufacturing cost of an image forming apparatus, since two different types of driving force transmitting apparatuses must be manufactured.

SUMMARY OF THE INVENTION

The primary object of the present invention is to provide, without increase in manufacturing cost, a driving force transmitting apparatus capable of improving an image forming apparatus in terms of speed (faster), image quality, and process cartridge capacity (larger), and also to provide an image forming apparatus having such a driving force transmitting apparatus.

Another object of the present invention is to provide a driving force transmitting apparatus comprising: a first transmitting means for transmitting driving force; a second transmitting means for transmitting driving force; a first mount to which the driving means is attached to drive said first and second transmitting means; a second mount to which the driving means is attached to drive said first transmitting means without driving said second transmitting means; a third mount to which the driving means is attached to drive said second transmitting means without-driving said first transmitting means, and also to provide an image forming apparatus having such a driving force transmitting apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Figure 11:
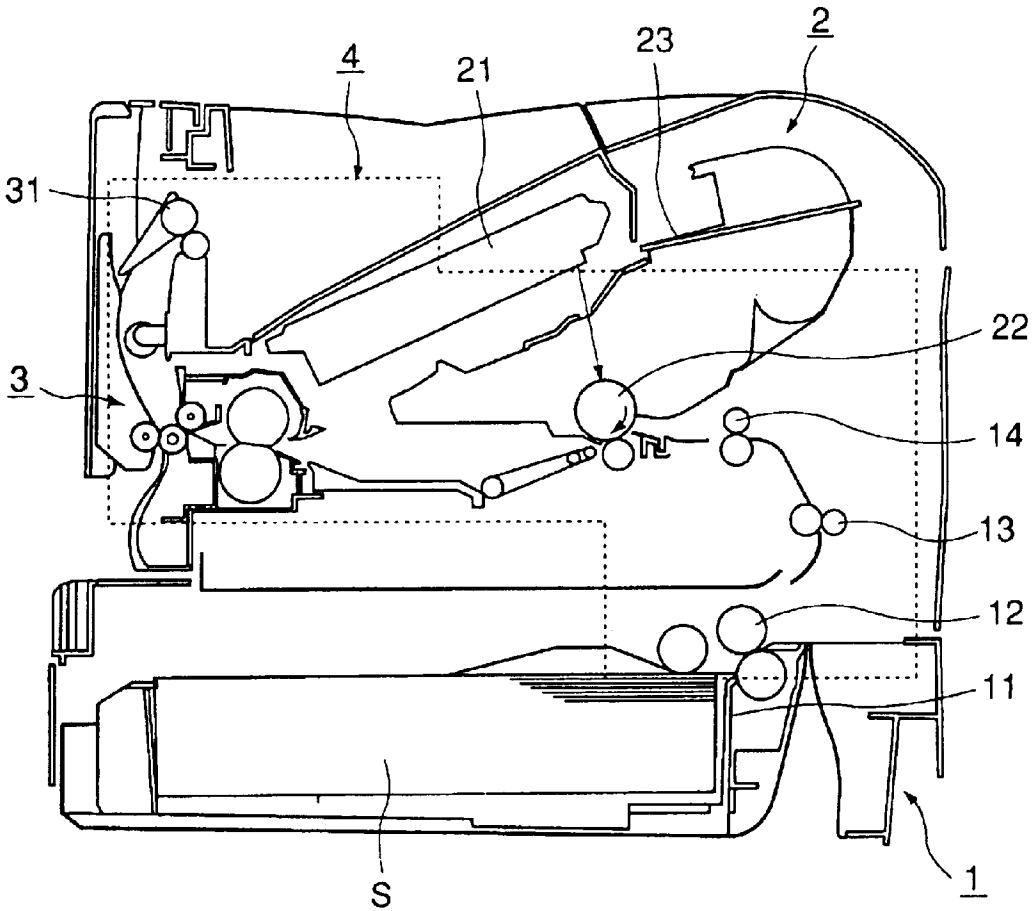
FIG. 11 (PRIOR ART)
FIG. 11 is a schematic sectional view of a typical image forming apparatus in accordance with the prior art.

The general structure of the image forming apparatus in accordance with the present invention is similar to that of the apparatus in FIG. 11. Thus, only the driving force transmitting apparatus thereof, which characterizes the present invention, will be described. The members, components, portions, etc., which are the same in function as those of the apparatus described with reference to FIG. 12, will be given the same referential numerals as those in FIG. 12, and will not be described.

Figure 1:
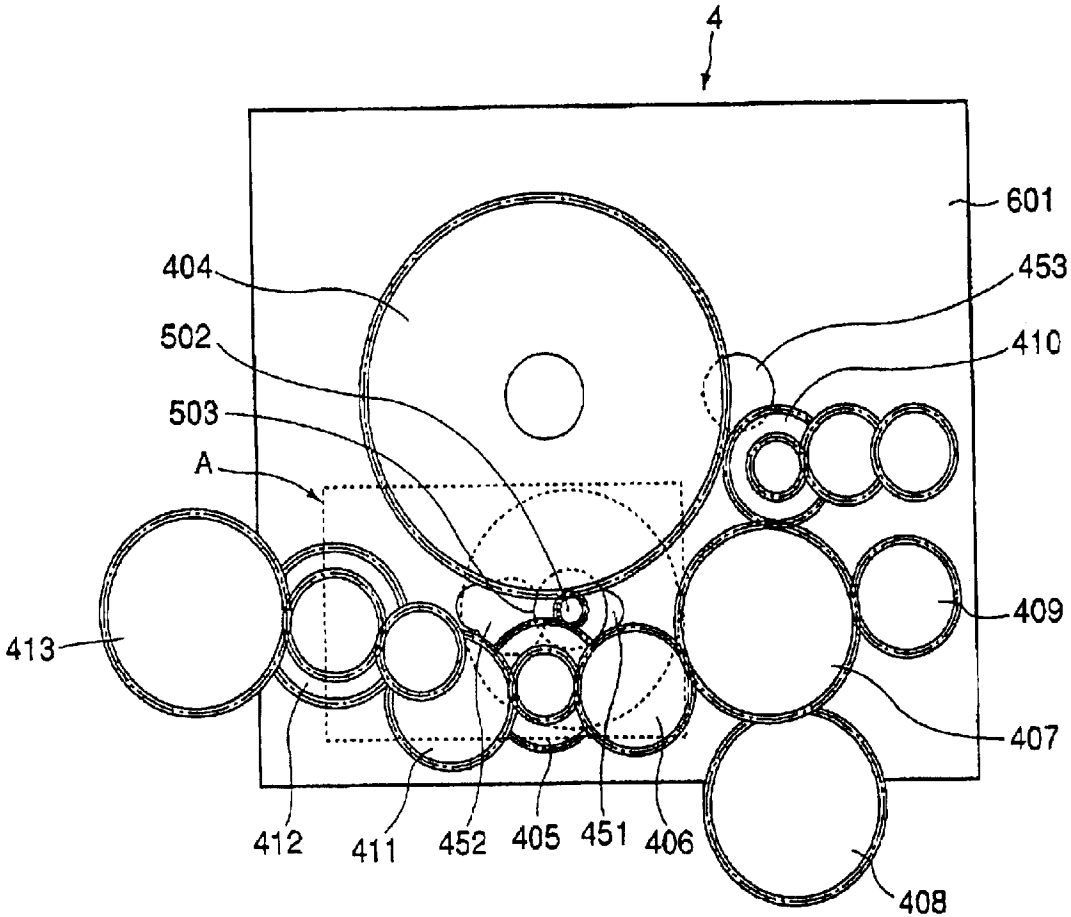
FIG. 1 is a schematic drawing of the first embodiment of a driving force transmitting apparatus in accordance with the present invention, which comprises a single motor.
Figure 2:
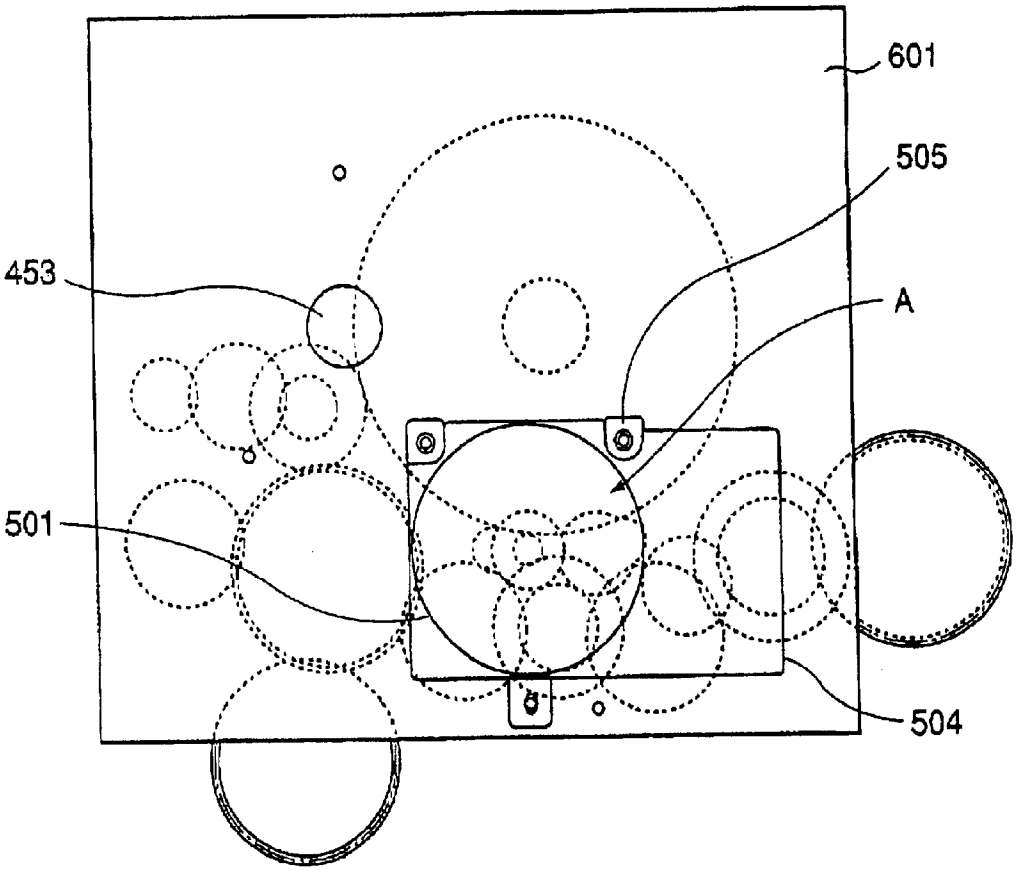
FIG. 2 is a rear view of the driving force transmitting apparatus in FIG. 1.
Figure 3:
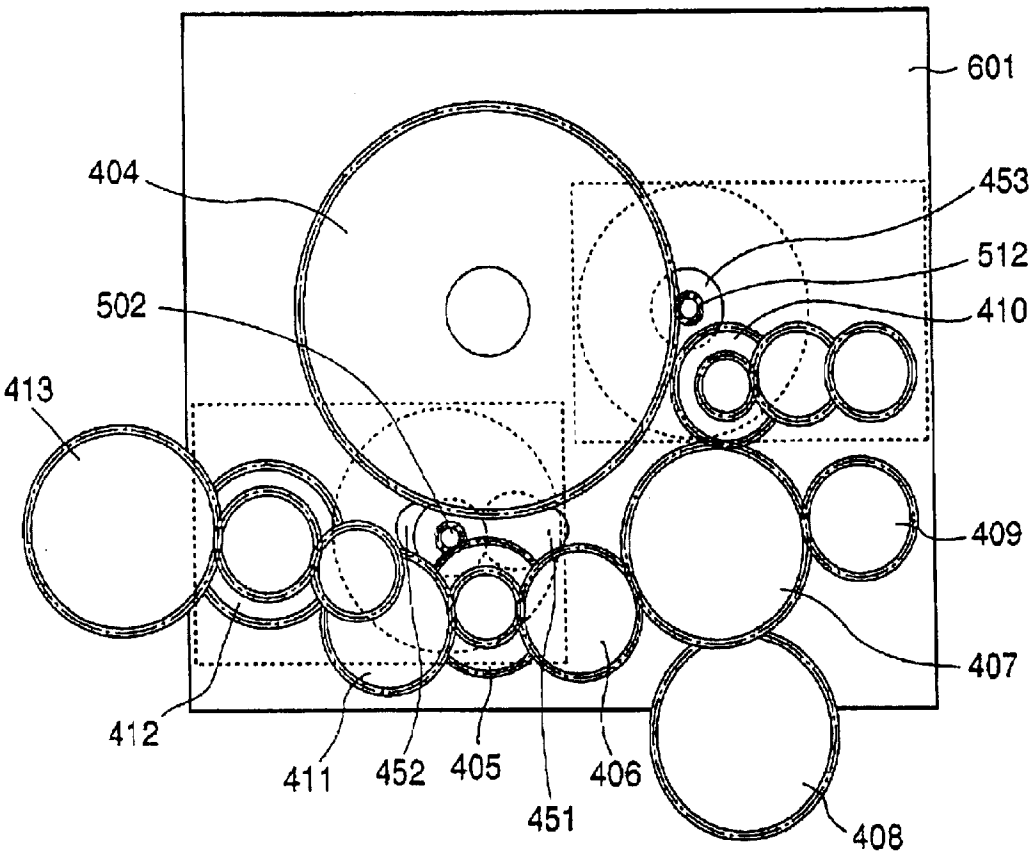
FIG. 3 is a schematic drawing of the first embodiment of a driving force transmitting apparatus in accordance with the present invention, which comprises two motors.
Figure 4:
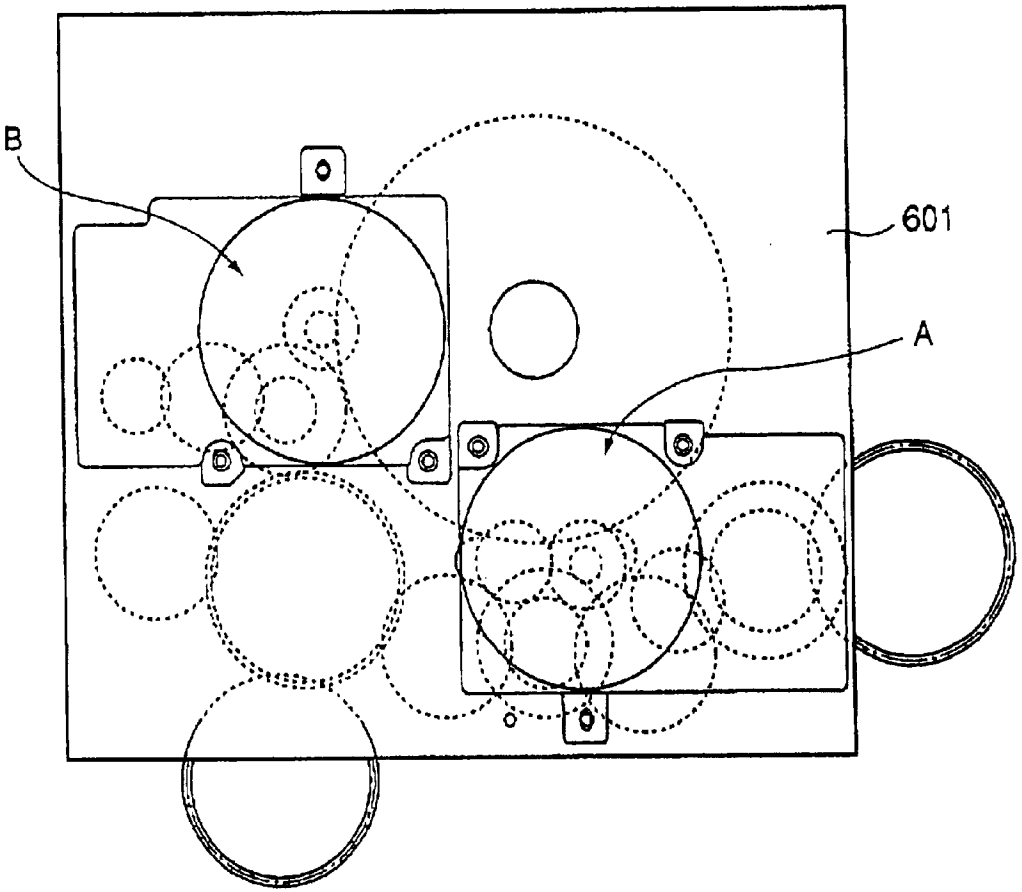
FIG. 4 is a rear view of the driving force transmitting apparatus in FIG. 3.
Figure 5:
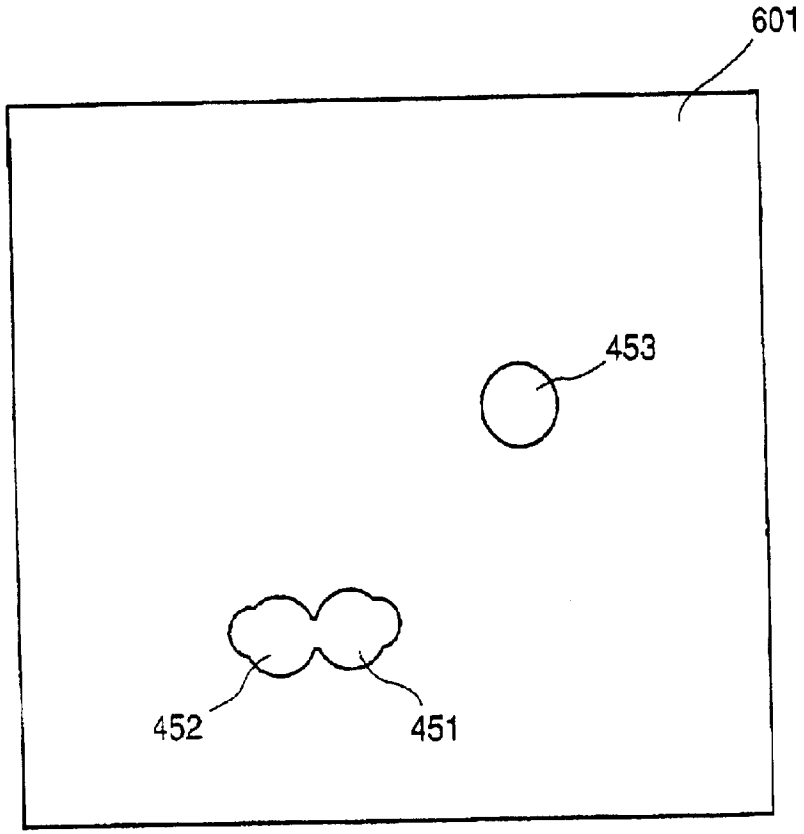
FIG. 5 is a plan view of the side plate of the driving force transmitting apparatus.

Referring to FIGS. 1-8, the first embodiment of the present invention will be described. FIG. 1 is a schematic drawing of the first embodiment of a driving force transmitting apparatus in accordance with the present invention, which is driven by only a single motor. FIG. 2 is a schematic rear view of the driving force transmitting apparatus in FIG. 1. FIG. 3 is a schematic drawing of the first embodiment of a driving force transmitting apparatus in accordance with the present invention, which is driven by two motors. FIG. 4 is a schematic rear view of the apparatus in FIG. 3. FIG. 5 is a schematic drawing of the side plate of the driving force transmitting apparatus.

Referring to FIG. 1, this embodiment of a driving force transmitting apparatus (driving force transmitting portion) is a gear unit comprising a plurality of gears, as driving force transmitting members, arranged in the predetermined manner. This gear unit has a plurality of motor mounts to which a motor as a driving means is mountable. More concretely, referring to FIG. 5, a side plate 601, which constitutes the base member of the driving force transmitting apparatus, has first, second, and third motor mounts 451, 452, and 453, to which a motor as a driving means is mounted. Referring to FIGS. 1 and 3, the first motor mount has a hole 451 where the pinion gear 502 of the motor meshes with gears 404 and 405. The second motor mount has a hole 452 where the pinion gear 502 of the motor meshes with only the gear 405. The third motor mount has a hole 453 where the pinion gear 512 of the motor meshes with only the gear 404. In this embodiment, the holes 451 and 452 are connected.

Figure 6:
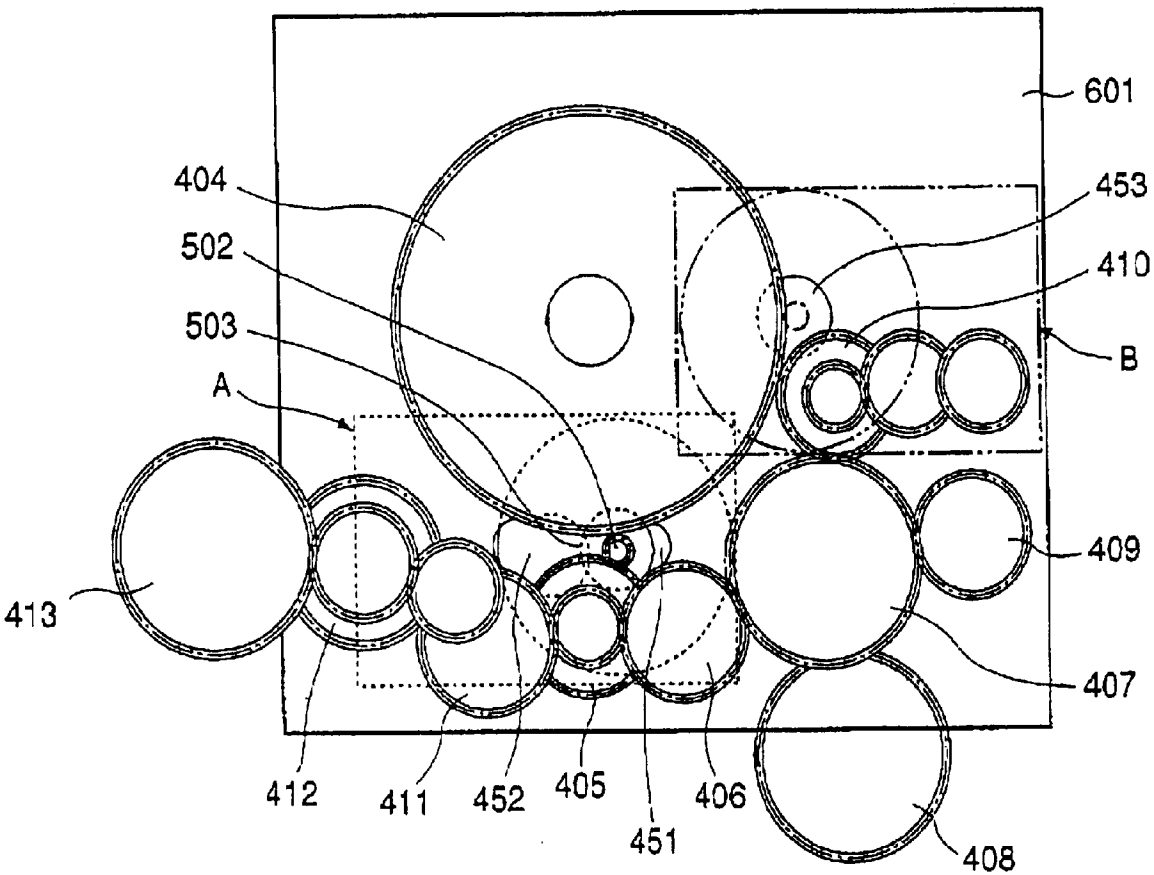
FIG. 6 is a schematic drawing the driving force transmitting apparatus in accordance with the present invention, for showing the interference between two motors, which occurs as the motors are erroneously mounted.
Figure 7:
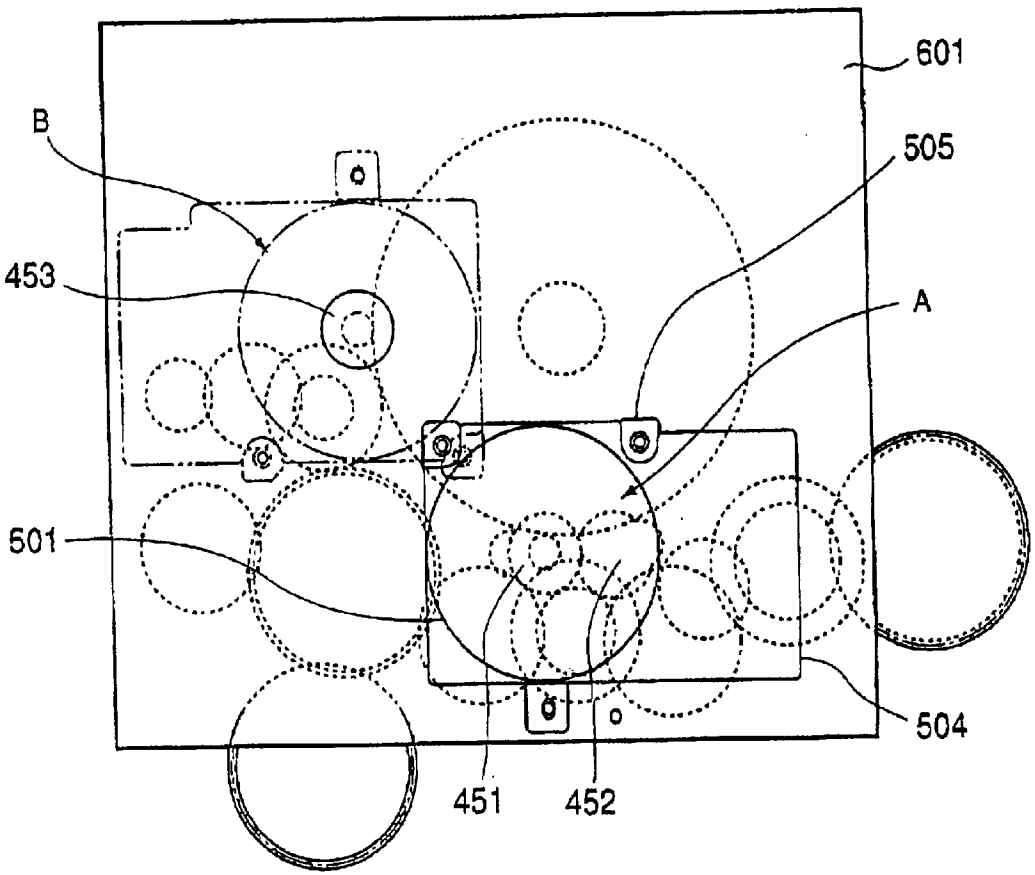
FIG. 7 is a rear view of the driving force transmitting apparatus in FIG. 6.

The positional relationship among the motor mount holes 451, 452, and 453 is such that if a motor is mounted in alignment with the first motor mount hole 451, the motor interferes with both the second and third motor mount holes 452 and 453, making it impossible to mount additional motors. FIGS. 6 and 7 show an example of such a design; if an attempt is made to mount a motor B with a motor A being already in hole 451, the motors A and motor B interfere with each other.

The motor employed in this embodiment is an ordinary DC motor of an outer rotor type. Referring to FIGS. 1 and 2, basically, it comprises: a rotor 501, a pinon gear 502, a housing 503, a base board 504, and a metallic anchoring plate 505. The motor A mountable in alignment with the first or second motor mount holes 451 or 452 is different in the shapes of the metallic anchoring plate 505, base member 504, and rotor, from the motor B mounted in alignment with the third motor mount hole 453.

Next, the function of this driving force transmitting apparatus will be described. First, referring to FIGS. 1 and 2, in the case of a setup in which the force for driving an image forming apparatus is provided by only a single motor, or motor A, the motor A is mount in alignment with the first motor mount hole 451. When the motor A is in this position, the gears and coupling are engaged as follows. Referring to FIG. 1; the pinion gear 502 of the main motor A is in mesh with the gear 404, which is connected to the photoconductive member 22 through a coupling, transmitting driving force to the photoconductive member 22. The driving force is further transmitted from the photoconductive member 22 in order to stir the toner in the process cartridge 23, with the interposition of a idler gear (unshown).

The pinion gear 502 is also in mesh with the gear 405, transmitting the driving force to the sheet feeding roller 12 through the gears 406, 407, and 408. It also transmits the driving force to the pair of conveying rollers 13 through the gear 406, 407, and 409, and to the pair of conveying rollers 14 through the gear 406, 407, and 410.

Figure 12:
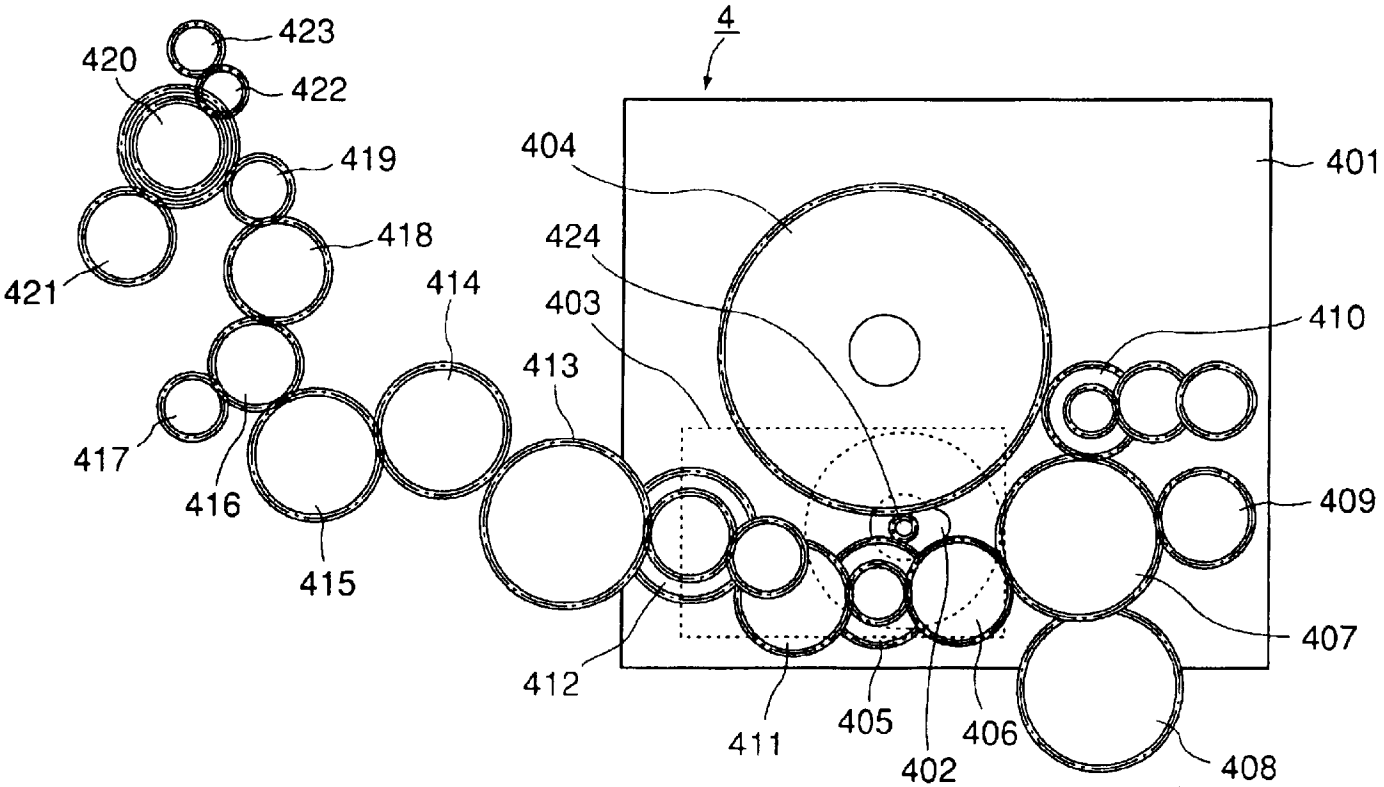
FIG. 12 (PRIOR ART)
FIG. 12 is a schematic drawing of the driving force transmitting apparatus in FIG. 11.

Further, the pinion gear 502 transmits the driving force to the fixing portion 3 and pair of discharge rollers 31, through gears 411–423 (see FIG. 12 for gears 414–423). In other words, the gear 404 is the first driving force transmitting means, and the gears 405–423 make up the second driving force transmitting means.

In the case of the setup shown in FIG. 1, both the first and second driving force transmitting means are driven by a single motor, or the main motor A, transmitting the driving force to the sheet feeding portion 1, image forming portion 2, and fixing portion 3.

In the case of the setup in which the motor A is mounted in alignment with the first motor mount hole 451, the second motor mount hole 452 is covered by the metallic anchoring plate 505 for the motor A, making it impossible to mount another motor in alignment with the second motor mount hole 452.

Further, if an attempt is made to mount the motor B in alignment with the third motor mount hole 453, the metallic anchoring plates 505 of the motors A and B interfere with each other, as shown in FIGS. 6 and 7, making it impossible to mount the motor B.

Figure 8:
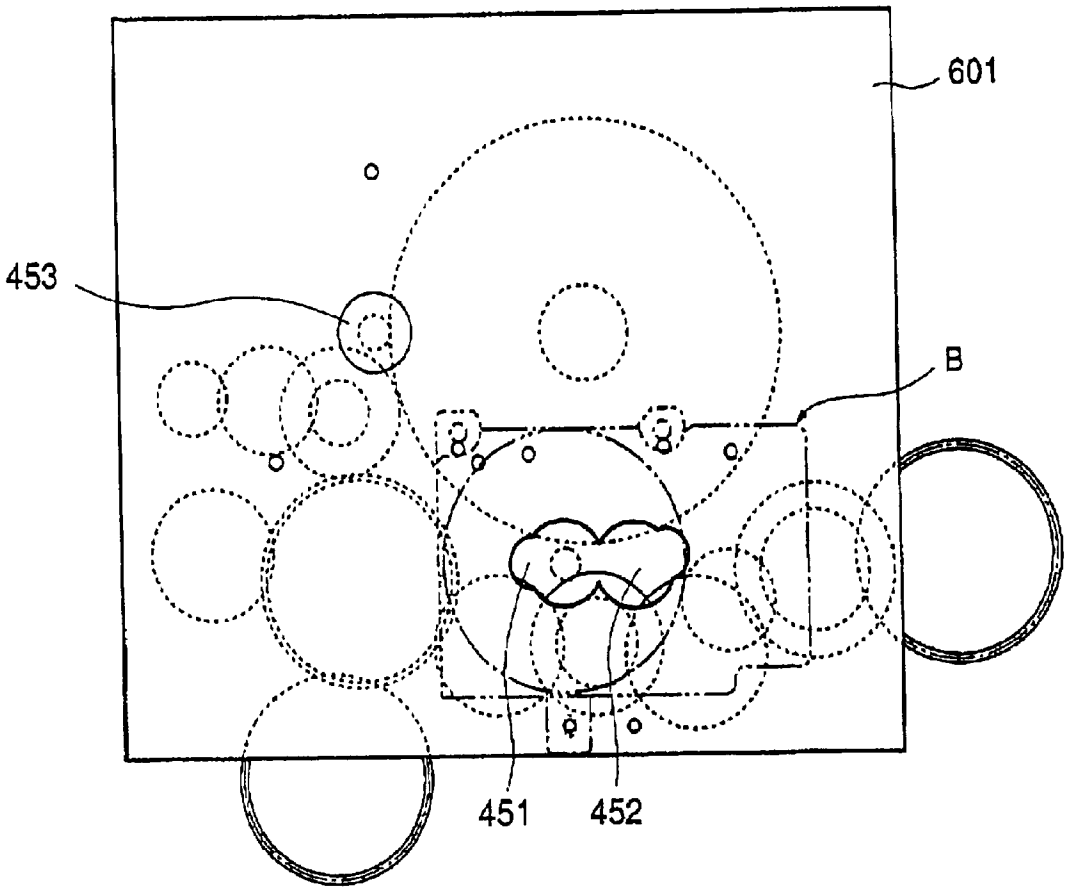
FIG. 8 is a schematic drawing for describing why it is impossible to erroneously mount a motor in the driving force transmitting apparatus in accordance with the present invention.

Further, the metallic anchoring plate of the motor B is different in shape from that of the motor A. Therefore, if an attempt is made to mount the motor B in alignment with the first motor mount 451 as shown in FIG. 8, the screw holes of the metallic anchoring plate of the motor B do not align with the screw holes of the side plate 601, making it impossible to attach the metallic anchoring plate of the motor B to the side plate 601, with the small screws. In other words, the motor B cannot be mounted in alignment with the first motor mount hole 451.

As described above, in the case of this embodiment of a driving force transmitting apparatus for driving the entirety of the apparatus with the use of only a single motor, it is impossible to erroneously mount the motor to the second or third motor mount. Therefore, it does not occur that the apparatus, or the motor, gears, etc., thereof become damaged due to the erroneous mounting of the motor. Also, it does not occur that a wrong motor is mounted.

In comparison, the same driving force transmitting apparatus as that described above is used to accomplish the object of improving an image forming apparatus in terms of speed (faster), image quality, and process cartridge capacity (larger), the motor B is mounted in alignment with the third motor mount hole 453 in order to transmit the driving force to the image forming portion, as shown in FIGS. 3 and 4, so that the driving force from motor B is directly transmitted to the image forming portion 2 that is, independently from the other portions. Further, in order to provide the sheet feeding portion 1 and fixing portion 3 with the driving force, the motor A is mounted in alignment with the second motor mount hole 452.

In this case, the pinion gear 502 of the motor A meshes with the gear 405, but does not mesh with the gear 404. Therefore, the second driving force transmitting means is driven by the motor A, but the first driving force transmitting mean is not driven by the motor A. Further, the pinion gear 512 of the motor B meshes only with the gear 404. Therefore, the first driving force transmitting means is driven by the motor B, but the second driving force transmitting means is not driven by the motor B.

In this case, the metallic anchoring plate for mounting a motor in alignment the third motor mount hole 453 is different in shape from that for mounting a motor in alignment with the second motor mount hole 452 as described above, making it impossible to mount the motor A in alignment with the third motor mount hole 453, using small screws. Thus, an attempt to mount the motor A in alignment with the third motor mount hole 453 will surely fail. Further, an attempt to mount the motor D in alignment with the first or second motor mount hole 451 or 452 will surely fail because it is impossible to put small screws through the screw holes due to the difference in shape between the metallic anchoring plate for mounting a motor in alignment with the third motor mount hole 453 and the metallic anchoring plate for mounting a motor in alignment with the first motor mount hole 451, and the difference in shape between the metallic anchoring plate for mounting a motor in alignment with the third motor mount hole 453 and the metallic anchoring plate for mounting a motor in alignment with the second motor mount hole 452.

Next, the working of the driving force transmitting means will be described following the flow of a sheet of recording medium.

As a signal for starting a printing job is inputted into the image forming apparatus, the motor A, which is mounted in alignment with the second motor mount hole 452, begins to rotate to convey a single or plurality of the sheets of recording medium through the image forming portion, fixing portion, and discharging portion, in the sequential order. However, the rotation of the motor B is started after the completion of the preparatory processes, for example, process for increasing the temperature of the fixing portion to the level for image fixation, process for initializing the scanner, etc., and also, after the first sheet of recording medium has been conveyed close to the pair of conveying rollers 14. The rotation of the motor B is stopped, immediately after the completion of the formation of an image on the last sheet of recording medium in the printing job, whereas the rotation of the motor A is stopped, ending the print job, after the last sheet of recording medium is conveyed to the sheet discharging portion through the fixing portion, and is discharged from the sheet discharging portion.

In other words, in the case of this setup, the fixing portion, which requires a greater amount of torque, is driven by one motor, and the process cartridge is driven by another motor. Therefore, the two motors required to improve the image forming apparatus in terms of speed, and image quality, as well as process cartridge capacity, have only to be equal in output to, or smaller in output than, the motor employed in the above described setup in which the entirety of the apparatus is driven by a single motor; this setup makes it possible to reduce motor size. Further, this setup makes it possible to rotate the photoconductive member 22 only when necessary, making it therefore possible to extend the service life of the photoconductive member 22.

As described above, this embodiment of a driving force transmitting means in accordance with the present invention, for transmitting the driving force from a single motor for driving the entirety of an image forming apparatus, can be easily divided into two discrete driving systems, which can be independently driven, simply by switching the positions to which the motors are attached.

In other words, this embodiment of a driving force transmitting portion has: the first motor mount to which a motor is attached in order to drive the entire driving force transmitting portion with the use of a single motor; and second and third motor mounts to which two motors are attached in order to drive the driving force transmitting portion with the use of two motors. Therefore, it can be used by an apparatus with a standard speed as well as an apparatus with a speed higher than the standard speed, eliminating the need for making a driving force transmitting portion dedicated for an apparatus with a higher speed, reducing therefore the manufacturing cost for a driving force transmitting portion.

Further, according to this embodiment, once an image forming apparatus is set up to be driven by a single motor, the only motor mount to which the motor can be attached is the first motor mount; the motor cannot be mounted in alignment with the other motor mount holes, and vice versa. In this embodiment, a plurality of metallic anchoring plates different in shape are prepared as the means for preventing erroneous attachment of a motor, and/or preventing a wrong motor. However, the erroneous attachment of a motor and/or mounting of a wrong motor, may be prevented by preparing a plurality of base plates, housings, pinion gears, etc., different in shape.

Next, referring to FIGS. 9 and 10, the second embodiment of the present invention will be described.

The general structure of this embodiment of an image forming apparatus in accordance with the present invention is similar to that of the apparatus in FIG. 11. Thus, only the driving force transmitting apparatus thereof, which characterizes the present invention, will be described. The members, components, portions, etc., which are the same in function as those of the apparatus described with reference to FIG. 12, will be given the same referential numerals as those in FIG. 12, and will not be described.

Figure 9:
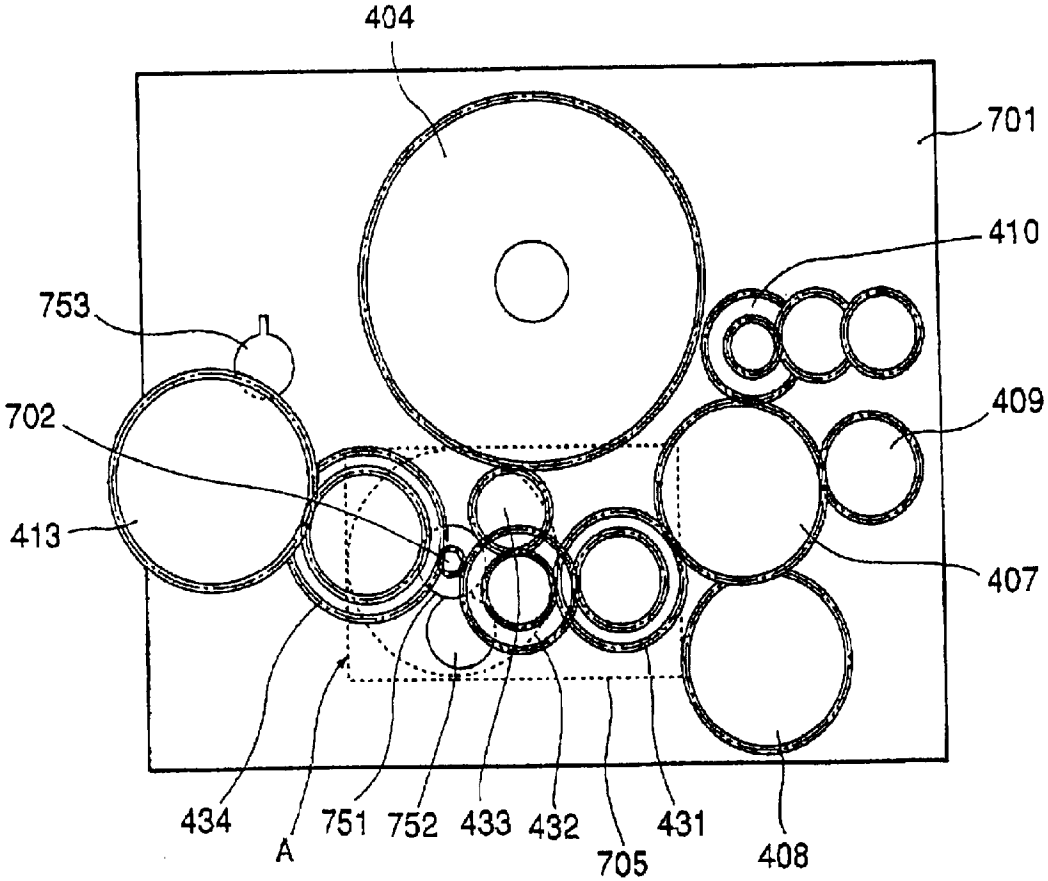
FIG. 9 is a schematic drawing of the second embodiment of a drawing force transmitting apparatus in accordance with the present invention, which comprises a single motor.
Figure 10:
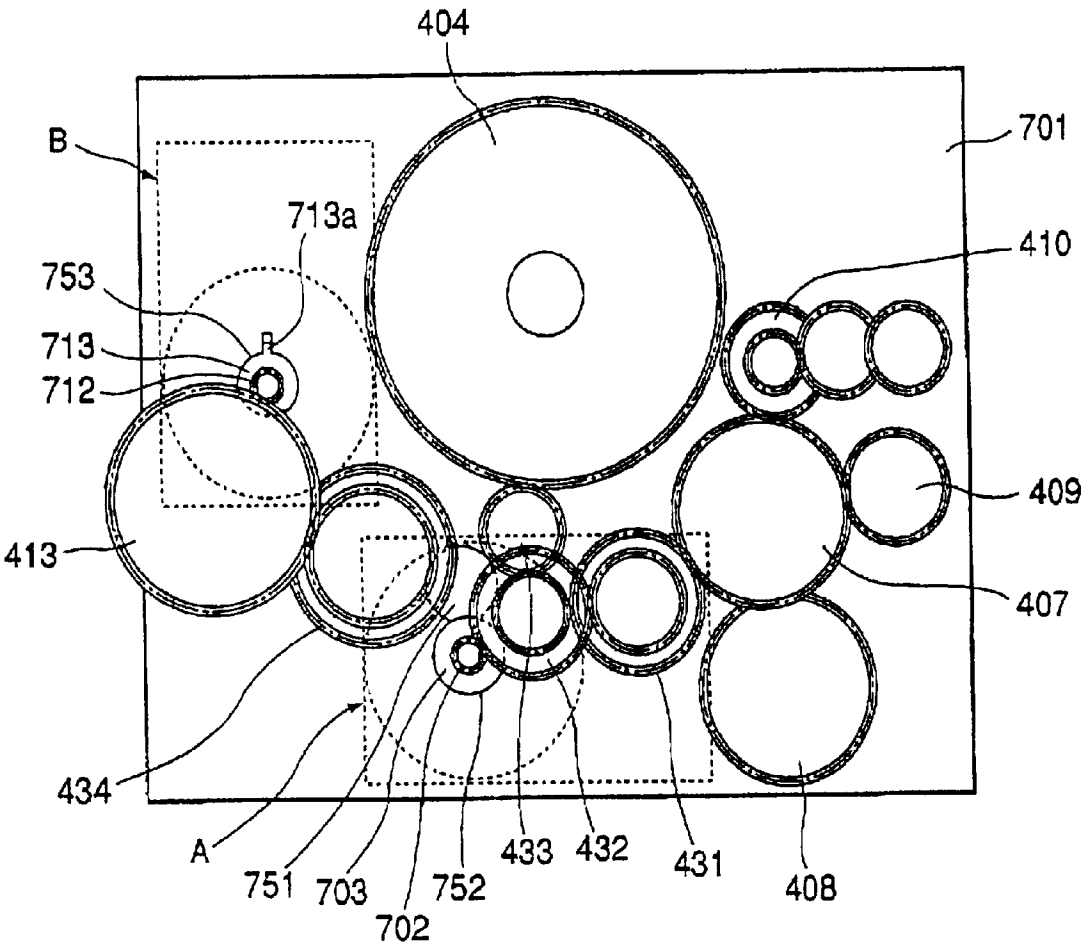
FIG. 10 is a schematic drawing of the second embodiment of a driving force transmitting apparatus, which comprises two motors.

FIG. 9 is a sectional view of the driving force transmitting portion of the main assembly of an image forming apparatus employing only a single motor for driving the entirety of the apparatus, and FIG. 2 is a sectional view of the driving force transmitting portion of the main assembly of an image forming apparatus employing two motors for driving the entirety of the apparatus.

The structure of this embodiment of a driving force transmitting apparatus is as follows. A side plate 701 has a first motor mount hole 751 where the pinion gear of the output shaft of the motor meshes with gears 432 and 434. A combination of the gear 432 and the gears connected directly or indirectly thereto, and a combination of the gear 434 and the gears connected directly or indirectly thereto, make up two discrete sets of gear trains. In other words, the driving force from the gear 432 is transmitted to the gear 407 through the gear 431, and is transmitted to the gear 404 through the gear 433, whereas the driving force from the gear 434 is transmitted to the gear 413.

The side plate 701 also has a second motor mount hole 752 where the pinion gear of the motor meshes only with the gear 432, and a third motor mount hole 753 where the pinion gear of the motor meshes only with the gear 413.

The positional relationship among the motor mount holes 751–753 is such that if a motor is mounted in alignment with the first motor mount hole 751, it becomes impossible to attach another motor either in alignment with the second motor mount hole 753 or the third motor mount hole 753.

The motors employed in this embodiment are ordinary DC motors of an outer rotor type, and their basic structures are the same as the motor employed in the first embodiment. The motor A mountable in alignment with the first or second motor mount hole 751 or 752 is different in the housing shape from the motor B mounted in alignment with the motor mount hole 753; the motor B has an appendage 713*a* like the blade portion of a key. The housing of the motor A is 20 mm in external diameter, whereas a housing 713 of the motor B is 18 mm in external diameter.

Next, the working of this embodiment of a driving force transmitting apparatus in accordance with the present invention will be described.

First, referring to FIG. 9, the case in which this embodiment is used as the driving force transmitting apparatus in an image forming apparatus driven by only a single motor will be described. In this case, the motor A is mounted in alignment with the first motor mount hole 751, as shown in FIG. 9. The pinion gear 702 of the main motor A is in mesh with the gear 432, which is in engagement with the gear 404 with the interposition of the gear 433. The gear 404 is in connection with the photoconductive member 22 through a coupling, transmitting the driving force from the main motor A to the photoconductive member 22. The driving force from the main motor A is further transmitted from the photoconductive member 22 through an idler gear (unshown) to stir the toner in the process cartridge 23. The gear 432 also transmits the driving force to the sheet feeding roller 12 through the gears 431, 407, and 408, to the pair of conveying rollers 13 through the gears 431, 407, 409, and to the pair of conveying rollers 14 through the gears 431, 407, and 410.

The pinion gear 702 is also in mesh with the gear 434, transmitting the driving force to the fixing portion 3, and the pair of sheet discharging rollers 31, through the gears 413–423 (see FIG. 12, for gears 414–423). In other words, the gears 404, 407–410, and 431–433 together make up the first driving force transmitting means, and the gears 413 and 434 make up the second driving force transmitting means.

In the case of the setup shown in FIG. 9, both the first and second driving force transmitting means are driven by a single motor, that is, the main motor A, transmitting the driving force from the main motor A to the sheet feeding portion 1, image forming portion 2, and fixing portion 3.

As the motor A is mounted in alignment with the motor mount hole 751, the second motor mount hole 752 is covered with the metallic anchoring plate 705. Therefore, it is impossible to mount another motor. Further, if an attempt is made to mount a motor in alignment with the third motor mount hole 753, the two metallic anchoring plates interfere with each other as they did in the first embodiment, preventing another motor from being mounted in alignment with the third motor mount hole 753. Further, the attempt to mount the motor B in alignment with the first motor mount hole 751 will surely fail, because not only is the housing of the motor B different in external diameter from that of the motor A, but also, the appendage of the housing of the motor B, which is shaped like the blade portion of a key, interferes with the side plate 701, preventing the motor B from being mounted in alignment with the first motor mount hole 751.

Therefore, in the case of an image forming apparatus employing only a single motor to drive the entirety of the apparatus, it is impossible to erroneously mount a motor in alignment with the second or third motor attachment position. Thus, it does not occur that the apparatus, and the motor, gear, etc., thereof, are damaged due to the erroneous mounting of the motor. Further, it is impossible for a wrong motor to be mounted.

In comparison, in order to accomplish the object of improving an image forming apparatus in speed, and image quality, as well as process cartridge capacity, using the same driving force transmitting portion as that employed by an image forming apparatus employing only a single motor, the motor B is mounted in alignment with the third motor mount hole 753 to transmit driving force to the fixing portion 3 from a driving force source different from the driving force source for driving the sheet feeding portion 1 and image forming portion 2, whereas the motor A is mounted in alignment with the second motor mount hole 752 to transmit driving force to the sheet feeding portion 1 and image forming portion 2.

In this case, the pinion gear 702 of the motor A is in mesh with the gear 432, but it is not in mesh with the gear 434. Therefore, the first driving force transmitting means is driven by the motor A, but the second driving force transmitting means is not driven by the motor A. Further, the pinion gear 712 of the motor B is in mesh with only the gear 413. Therefore, the second driving force transmitting means is driven by the motor B, but the first driving force transmitting means is not driven by the motor B.

Also in this case, an attempt to mount the motor A in alignment with the third motor mount hole 753 will surely fail, because the external diameter of the housing of the motor A is different from that of the motor B. Further, an attempt to mount the motor B in alignment with the first or second motor mount hole 751 or 752 will surely tail, because not only is the motor B different in the housing diameter from the motor A, hut also, the key-like appendage of the housing of the motor B interferes with the side plate 701.

Next, the transmission of the driving force by this driving force transmitting apparatus will be described following the flow of a sheet of recording medium. As a signal for starting a printing job is inputted into the image forming apparatus, the motor A mounted in alignment with the second motor mount hole 752 to convey a single or plurality of sheets of recording medium to the image forming portion, begins to rotate, and also, the motor B mounted in alignment with the third motor mount hole 753 in order to drive the fixing portion and discharge the sheets of recording medium, begins to rotate.

The rotation of the motor A is stopped immediately after the formation of an image on the last sheet of recording medium in the printing job, although the rotation of the motor B is continued to fix the unfixed toner image on the last sheet of recording medium, and discharge the last sheet of recording medium. Then, the rotation of the motor B is stopped after the discharging of the last sheet of recording medium, ending the printing job.

Thus, this embodiment of the present invention is capable of providing the same effects as those provided by the first embodiment of the present invention. In particular, in the case of this embodiment, the fixing portion is independent from the image forming portion, and is driven independently from the image forming portion. Therefore, the employment of this embodiment is effective when the load which applies to the fixing portion increases due to the increased operational speed of an image forming apparatus.

Incidentally, in this embodiment, the erroneous mounting of a motor is prevented by varying motors in the housing shape. However, it may be prevented by varying the motors in the base board shape, or by varying in shape, as is in the first embodiment, the motors, metallic anchoring plate, pinion gear of the motor, etc.

Further, in the above described embodiments, one of the two motors employed by an image forming apparatus which employs two motors to drive the entire apparatus, is the same as the motor A, which is employed by an image forming apparatus which employs only a single motor to drive the entire apparatus. However, it may be different from the motor A.

Although the preceding embodiments were described with reference to the image forming apparatus employing only a single motor, and the image forming apparatus employing two motors, there is no limitation to the number of motors; the number of the motors to be employed may be varied according to need.

As described above, according to the present invention, a driving force transmitting apparatus has a motor mount to which a motor is mounted only when the driving force transmitting apparatus is used for an image force apparatus employing only a single motor, and two or more motor mounts to which two or more motors are mounted, one for one, when the driving force transmitting apparatus is employed by an image forming apparatus employing two more motors. Thus, a driving force transmitting apparatus in accordance with the present invention can be employed by either an image forming apparatus which operates at the standard speed, or an image forming apparatus which operates at a higher speed, without complicated modifications, that is, with the simple selection of the motor mount or mounts. In other words, a driving force transmitting apparatus in accordance with the present invention, for an image forming apparatus employing only a single motor for driving the entirety of the image forming apparatus, can be easily modified into a driving force transmitting apparatus for an image forming apparatus employing two or more motors, simply by mounting the two or more motors to the driving force transmitting apparatus, as necessary.

In other words, according to the present invention, a driving force transmitting apparatus designed for an image forming apparatus which operates at the standard speed can also be employed as the driving force transmitting apparatus for an image forming apparatus which operates at a higher speed; a driving force transmitting apparatus in accordance with the present invention can be employed by various types of image forming apparatuses, making it possible to reduce the manufacturing cost for a driving force transmitting apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A driving force transmitting apparatus comprising:

first and second transmitting means for transmitting a driving force;

a first mounting portion for mounting driving means for driving both of said first and second transmitting means;

a second mounting portion for mounting driving means driving said first transmitting means and not driving said second transmitting means; and a third mounting portion for mounting driving means driving said second transmitting means and not driving said first transmitting means.

2. An apparatus according to claim 1, wherein when driving means is mounted to said first mounting portion, driving means is prohibited from being mounted to said second mounting portion and said third mounting portion.

3. An apparatus according to claim 1, wherein when driving means is mounted to said second mounting portion and said third mounting portion, driving means is prohibited from being mounted to said first mounting portion.

4. An apparatus according to claim 1, wherein driving means mounted to said first mounting portion is prohibited from being mounted to said third mounting portion.

5. An apparatus according to claim 1, wherein the driving means mounted to said third mounting portion is prohibited from being mounted to said first mounting portion.

6. An apparatus according to claim 1, wherein said first and second transmitting means have respective gears.

7. An apparatus according to claim 1, wherein said first mounting portion, said second mounting portion and said third mounting portion are motor mounting portions.

8. An image forming apparatus comprising:

image forming means for forming an image on a recording material;

driving force transmitting means for transmitting a driving force to said image forming means, said driving force transmitting means including, first and second transmitting means for transmitting a driving force;

a first mounting portion for mounting driving means for driving both of said first and second transmitting means;

a second mounting portion for mounting driving means driving said first transmitting means and not driving said second transmitting means; and a third mounting portion for mounting driving means driving said second transmitting means and not driving said first transmitting means.

9. An apparatus according to claim 8, wherein when driving means is mounted to said first mounting portion, driving means is prohibited from being mounted to said second mounting portion and said third mounting portion.

10. An apparatus according to claim 8, wherein when driving means is mounted to said second mounting portion and said third mounting portion, driving means is prohibited from being mounted to said first mounting portion.

11. An apparatus according to claim 8, wherein driving means mounted to said first mounting portion is prohibited from being mounted to said third mounting portion.

12. An apparatus according to claim 8, wherein driving means mounted to said third mounting portion is prohibited from being mounted to said first mounting portion.

13. An apparatus according to claim 8, wherein said first and second transmitting means have respective gears.

14. An apparatus according to claim 8, wherein said first mounting portion, said second mounting portion and said third mounting portion are motor mounting portions.

15. An apparatus according to claim 8, wherein said image forming means includes an image forming station for forming an image on an image bearing member and a fixing station for fixing the image on the recording material, and wherein said first transmitting means transmits the driving force to said image forming station, and said second transmitting means transmits the driving force to said fixing station.

* * * * *

UNITED STATES PATENT AND TRADEMARK OFFICE

CERTIFICATE OF CORRECTION

PATENT NO. : 6,885,837 B2
DATED : April 26, 2005
INVENTOR(S) : Matsubara

It is certified that error appears in the above-identified patent and that said Letters Patent is hereby corrected as shown below:

Column 4,
Line 60, “mount” should read -- mounted --.

Column 5,
Line 67, “mean” should read -- means --.

Column 6,
Line 5, “the” should read -- with the --.

Signed and Sealed this

Twenty-fifth Day of April, 2006

JON W. DUDAS
*Director of the United States Patent and Trademark Office*